US005203527A

United States Patent [19]

Rubey

[11] Patent Number: 5,203,527

[45] Date of Patent: Apr. 20, 1993

[54] WRIST SUPPORT DEVICE FOR KEYBOARDS

[75] Inventor: Ulyss R. Rubey, Graham, Tex.

[73] Assignee: Media Recovery, Inc., Graham, Tex.

[21] Appl. No.: 845,697

[22] Filed: Mar. 4, 1992

[51] Int. Cl.[5] ..... A47F 5/00
[52] U.S. Cl. ..... 248/118; 248/918
[58] Field of Search ..... 248/118, 118.1, 918

[56] References Cited

U.S. PATENT DOCUMENTS

| | | | |
|---|---|---|---|
| 1,801,669 | 4/1931 | Hintz et al. . | |
| 4,482,063 | 11/1984 | Berke et al. | 211/69.1 |
| 4,545,554 | 10/1985 | Latino et al. | 248/118.1 |
| 4,621,781 | 11/1986 | Springer | 248/118 |
| 4,688,862 | 8/1987 | Fowler et al. | 312/325 |
| 4,913,390 | 4/1990 | Berke | 248/176 |
| 4,976,407 | 12/1990 | Schwartz et al. | 248/118.3 |
| 5,056,743 | 10/1991 | Zwar et al. | 248/918 X |
| 5,072,905 | 12/1991 | Hyatt | 248/918 |

FOREIGN PATENT DOCUMENTS

| | | | |
|---|---|---|---|
| 41989 | 12/1969 | Finland | 248/118.1 |

*Primary Examiner*—Robert W. Gibson, Jr.
*Attorney, Agent, or Firm*—Geoffrey A. Mantooth

[57] ABSTRACT

A wrist support device for keyboard operators is disclosed, the device being designed to prevent repetitive motion injury, a prevalent disease among keyboard operators. The device provides a member having upper and lower sections, with a gap between the sections. The gap is narrower than the front end of a keyboard, but may be widened to accept a keyboard by retracting the upper section from the lower section. The device is secured to the keyboard by releasing the retracted upper section, which attempts to achieve its rest position, thus clamping the device to the keyboard. The upper section provides a surface that supports a keyboard operator's wrists. The device adjusts to fit a keyboard operator's finger length by allowing the position of the upper section to be adjusted relative to the keyboard. Elastomeric strips and a pad aid in comfort and ease of use of the device.

19 Claims, 1 Drawing Sheet

WRIST SUPPORT DEVICE FOR KEYBOARDS

FIELD OF THE INVENTION

The present invention relates to a keyboard operator assisting device, namely a wrist support device for use while operating a keyboard.

BACKGROUND OF THE INVENTION

Keyboards are a primary way to input data into data processing systems. Keyboard operators often spend hours using a keyboard. Frequent users of computer keyboards are subject to repetitive motion injuries, including a disease known as carpal tunnel syndrome. Carpal tunnel syndrome results from inflamed tendons in the wrist constricting a tunnel of eight wrist bones. These bones put pressure on wrist nerves, resulting in pain, numbness and burning sensations in the fingers and thumbs. Extended use of a computer keyboard causes carpal tunnel syndrome because the operator's wrists are in motion while at an unnatural angle, resulting in inflamed tendons in the wrist.

Damage caused by carpal tunnel syndrome is generally irreversible. Therefore, the preferred action is to prevent the onset of carpal tunnel syndrome. Prevention is simple, requiring some hand and wrist exercises. Alternatively, the wrists can be supported while using the keyboard.

SUMMARY OF THE INVENTION

The invention discloses a device which reduces the risk of carpal tunnel syndrome for keyboard operators. The device comprises a member of stiffly resilient material having upper and lower sections, between which extends a gap. A keyboard is held in place in the gap between the upper and lower sections by securing means. The keyboard operator may rest his or her wrists on the upper section of the device while operating the keyboard. The upper and lower sections have two ends, where one end of the upper section is joined to one end of the lower section by connecting means. The gap extends from the other end of the upper section to the connecting means between the upper and lower sections. The length of the gap is much greater than the length of a keyboard's front end, therefore, the front of the keyboard may be adjusted away from, and towards, the connecting means while within the gap, allowing a keyboard operator to adjust the position of the keyboard relative to the device to accommodate the operator's finger length. Pad means provides a soft surface for a keyboard operator's wrists to rest upon while operating the keyboard. Elastomeric strips assist in operation of the device by providing a non-slip surface which helps grip the keyboard within the securing means, keeps the device from sliding while in use, and protects the surface upon which the device is placed.

The device helps reduce the risk of repetitive motion injury in two ways. First, the device elevates and supports the keyboard operator's wrists, eliminating the unnatural angle an unassisted operator's wrists are subject to. Second, the device enables the keyboard operator to reduce wrist motion while operating the keyboard. By performing these two functions, the device significantly reduces the chance that a keyboard operator will sustain a repetitive motion injury.

DESCRIPTION OF THE PREFERRED EMBODIMENT

Figure 1:
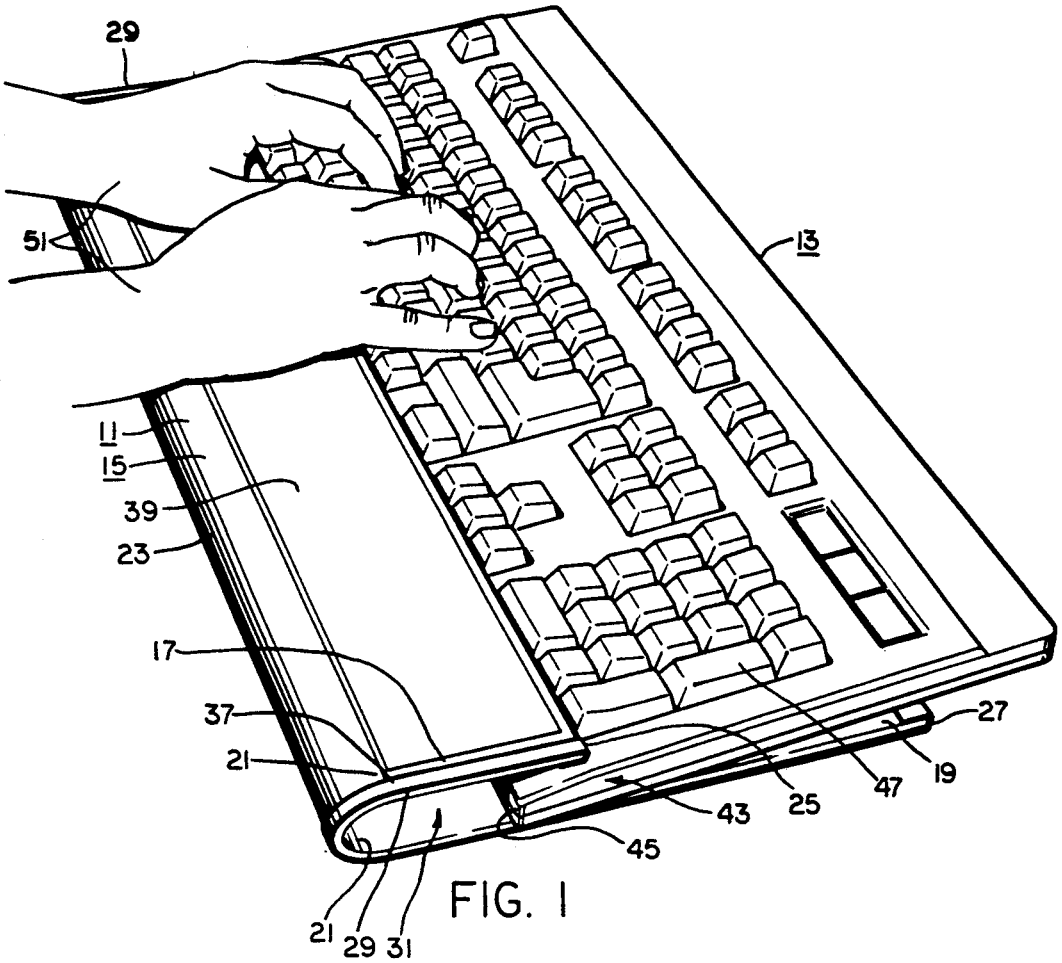
FIG. 1 shows a perspective view of the wrist support device of the present invention, in accordance with the preferred embodiment, with the wrist support device installed onto a keyboard.
Figure 2:
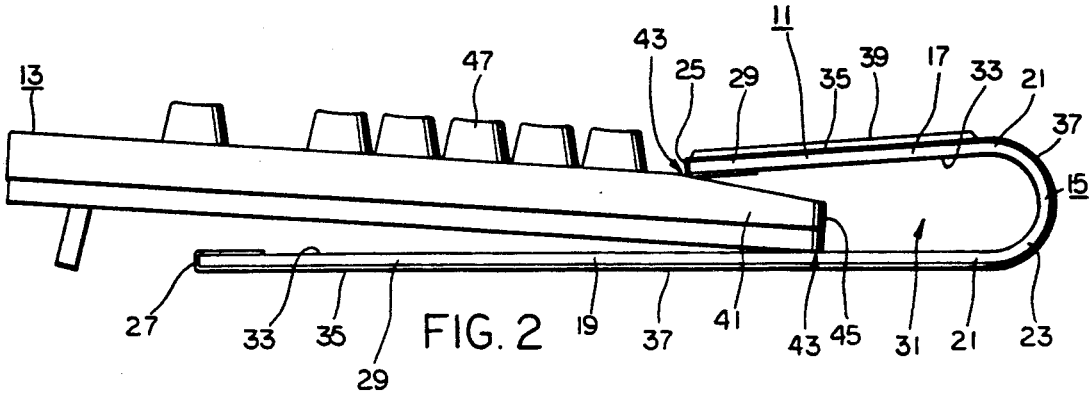
FIG. 2 shows a side view of the wrist support device of FIG. 1.

Referring now the drawings, there is illustrated the wrist support device 11 of the present invention, in accordance with the preferred embodiment. The device 11 is designed to support a keyboard operator's wrists to help prevent repetitive motion injuries caused by extensive use of a keyboard 13. The device 11 is attached to the keyboard 13 by clipping the device 11 to the keyboard 13.

The device 11 provides a member 15 of stiff, yet resilient plastic. The member 15 has an upper section 17 and a lower section 19, the lower section 19 having greater length than the upper section 17. The upper and lower sections 17, 19 are separated from each other by an air gap 31. Each of the upper and lower sections, 17, 19 has an end 21. The upper and lower sections 17, 19 are connected together at their respective ends 21 by a connecting means 23. In the preferred embodiment, the connecting means 23 is a rounded end 23 that is integral with the upper and lower sections 17, 19 of the member 15. Thus, the member 15 gives the appearance that the upper section 17 has been folded over the lower section 19, with the connecting means 23 forming the fold. The upper and lower sections 17, 19 are generally rectangular in shape, while the connecting means 23 is rounded. The upper section 17 is oriented at a slight angle with respect to the lower section 19 such that the gap 31 is wider at the connecting means 23 than at the back edge 25 of the upper section 17. This narrowing of the gap allows the upper and lower sections 17, 19 to clamp onto the keyboard 13. The member 15 has two side edges 29 extending from the back end 27 of the lower section 19 to the end 25 of the upper section. Additionally, the member 15 has inner and outer surfaces 33, 35 which extend along the upper and lower sections 17, 19.

In the preferred embodiment, additional features are attached to the member 15. Elastomeric strips 37 extend near the side edges 29, on the inner and outer surfaces 33, 35 of the member 15. The strips 37 are attached to the member 15 by an adhesive, and extend around the back edge 25 of the upper section 17, along the outer surface 35 of the upper section 15, around the connecting means 23, along the outer surface 35 of the lower section 19, and around the back edge 27. The elastomeric strips 37 are typically composed of foam rubber.

Another feature attached to the member 15 in the preferred embodiment is pad means 39, which provides a relatively soft pad 39 for a keyboard operator's wrists or hands to rest upon. The pad means 39 is attached to the outer surface 35 of the upper section 17 by an adhesive. Typically, the pad means 39 will extend from side edge 29 to side edge 29 of the member 15, and from the connecting means 23 to the back edge 25 of the member 15 across the outer surface 35 of the upper section 17. In the preferred embodiment, the pad means 39 is comprised of a ⅛ inch thick foam rubber pad 39.

The member 15 is used to support a keyboard operator's wrists and hands by providing a surface upon which the operator's wrists or hands may rest while operating the keyboard 13. The member 15 reduces the risk of repetitive motion injury by reducing the amount of wrist and hand motion necessary to operate a keyboard 13. The member 15 is attached to a keyboard 13 by clipping the upper and lower sections 17, 19 to the front edge portion 41 of the keyboard. The upper and lower sections 17, 19 act as securing means 43, gripping the front edge portion 41 of the keyboard to hold the member 15 firmly to the keyboard 13. The lower section 19 also extends underneath the keyboard 13 to provide a support surface for the keyboard 13. When the device 11 is installed on a keyboard 13, the upper section, which supports the operator's wrists 51, is at about the same elevation as the keys 47. The rounded connecting means 23 presents a contoured surface to the operator's wrists 51 so as to further provide comfortable operation.

In the preferred embodiment, the connecting means 23 and upper and lower sections 17, 19 of the member 15 form a clamp 43, which grasps the front edge portion 41 of the keyboard. The front edge portion 41 of the keyboard extends from the front edge 45 of the keyboard to the keyboard keys 47. To install the support device Il onto the keyboard 13, the gap 31 is widened by spreading apart the upper and lower sections 17, 19. While the upper section 17 is being pulled away from the lower section 19, the front edge portion 41 of the keyboard is inserted into the gap 31 between the sections 17, 19. When the keyboard 13 is in place between sections 17, 19 the upper section 17 may be released. When the upper section 17 is released, the inner surface 33 of the upper section 17 at the front end 25 of the member 15 clamps down on the front of the keyboard 41, holding the keyboard 13 firmly against the inner surface 33 of the lower section 19. The connecting means 23 provides the clamping force to hold the keyboard 13 in place. Once the keyboard 13 has been clipped in place it will remain securely grasped by the member 15. The support device attaches to keyboards 13 of various thicknesses. Thus, the device 11 can be attached to thin keyboards and thicker keyboards.

The position of the upper section 17 may be adjusted relative to the keyboard 13 to accommodate the keyboard operator's finger length. The front edge portion 41 of the keyboard rests in the gap 31 between the upper and lower sections 17, 19. The gap 31 extends between the sections 17, 19 from the back edge 25 of the member 15 to the connecting means 23. The length of the gap 31 from the back edge 25 of the member 15 to the connecting means 23 is much greater than the length of the front edge portion 41 of the keyboard, so the keyboard 13 may be moved either away from or towards the upper section 17 within the gap 31. The keyboard operator may adjust the member 15 to accommodate longer fingers by moving the keyboard 13 away from the operator while holding the member 15 in the same position. The same process is used to accommodate users having shorter fingers, except the keyboard 13 is pulled towards the operator.

The elastomeric strips 37 and the pad means 39 enhance the comfort and ease of use of the device 11. The elastomeric strips 37 serve several purposes. First, the strips 37 help grip the keyboard 13 between the upper and lower sections 17, 19 of the member 15. The rubbery material provides a non-slip surface that grasps the keyboard 13 when the keyboard 13 has been clipped into the member 15. Second, the strips 37 protect the finish of the furniture top supporting the keyboard by providing a soft flexible material on which the member 15 rests that will not damage a surface or the finish on a surface. Third, the strips 37 keep the member 15 and keyboard 13 from sliding on the surface. The strips 37 provide a non-slip surface that contacts the surface on which the member 15 and keyboard 13 are placed, thus keeping the device 11 from sliding while in use. The pad means 39 provides a soft surface for the keyboard operator's wrists and hands to rest upon, preventing discomfort that could be caused by operation of the device 11 without a pad covering the outer surface 35 of the upper section 17.

The member 15 is composed of a flexible, yet stiff plastic material. Some of the plastics suitable for creating the member 15 are styrene, acrylic, P.V.C., A.B.S. and polycarbonate. The plastics may be thermoformed, extruded or injection molded to create the member 15. The elastomeric strips 37 and the pad means 39 may be composed of polyurethane foam or rubber.

The foregoing disclosure and showings made in the drawings are merely illustrative of the principles of the invention and are not to be interpreted in a limiting sense. The present invention should be limited only by the following claims:

I claim:

1. A wrist support apparatus for a keyboard comprising:

a) a member having upper and lower sections, where said upper and lower sections form a gap in said member which gap is adapted to receive said keyboard and said upper section being adapted to support a keyboard operator's wrists for comfortable operation of said keyboard;

b) resilient connecting means for connecting the upper and lower sections of said member together, each of said upper and lower sections having respective first and second ends, said connecting means being coupled to said respective first ends of the upper and lower sections of said member, said gap forming an opening at said respective second ends of said upper and lower sections, which opening communicates with said gap and is structured and arranged to receive said keyboard, said connecting means for clamping the upper and lower sections onto said keyboard when said keyboard is inserted into said gap between said respective second ends.

2. The wrist support apparatus of claim 1, wherein said keyboard has a front edge portion that has a length, said gap is longer than said keyboard front edge portion length, so that the front edge portion of said keyboard may be adjusted within the gap for the purpose of allowing a keyboard operator to adjust said member to fit the operator's finger length.

3. The apparatus of claim 2, further comprising:

a) inner and outer surfaces of said member, where said inner surface extends along said upper and lower sections and may grip said keyboard therebetween, and said outer surface extends along said upper and lower sections where said outer surface of aid lower section may rest on a desk or table and said outer surface of said upper section provides a surface that may be used to support a keyboard operator's wrists;

b) pad means for increasing said keyboard operator's comfort by providing a soft surface upon which the operator's wrists or hands may rest, said pad means being located on the outer surface of said upper section of said member.

4. The apparatus of claim 3, wherein said pad means comprises a foam rubber pad that is affixed by an adhesive to said outer surface of said upper section.

5. The apparatus of claim 2, further comprising elastomeric strips extending along said upper and lower sections of said member, where said elastomeric strips provide desktop finish protection and prevent slippage of the apparatus and said keyboard, as well as aid in gripping said keyboard between said upper and lower sections of said member.

6. The apparatus of claim 3, further comprising elastomeric strips extending along portions of said inner surface of said upper and lower sections of said member, where said elastomeric strips provide desktop finish protection and prevent slippage of the apparatus and said keyboard, as well as aid in gripping said keyboard between said upper and lower sections of said member.

7. The apparatus of claim 4, further comprising elastomeric strips extending along said upper and lower sections of said member, where said elastomeric strips provide desktop finish protection and prevent slippage of the apparatus and said keyboard, as well as aid in gripping said keyboard between said upper and lower sections of said member.

8. The apparatus of claim 7, wherein said connecting means is formed by said member folding over on itself so that a rounded end is created, where said rounded end is integrally connected with said upper and lower sections.

9. An apparatus comprising:

a) a keyboard having a front edge portion and keys;

b) a member having upper and lower sections, where said upper and lower sections form a grasp in said member which gap is adapted to receive said keyboard and said upper section being adapted to support a keyboard operator's wrists for comfortable operation of said keyboard;

c) resilient connecting means for connecting the upper and lower sections of said member together, each of said upper and lower sections having respective first and second ends, said connecting means being coupled to said respective first ends of the upper and lower sections of said member, said gap forming an opening at said respective second ends of said upper and lower sections, which opening communicates with said gap and is structured and arranged to receive said keyboard, said connecting means for clamping the upper and lower sections onto said keyboard when said keyboard is inserted into said gap between said respective second ends.

d) said keyboard front edge portion having a length, said gap is longer than said keyboard front edge portion length, so that the front edge portion of said keyboard may be adjusted within the gap for the purpose of allowing a keyboard operator to adjust said member to fit the operator's finger length.

10. The apparatus of claim 9, further comprising:

a) inner and outer surfaces of said member, where said inner surface extends along said upper and lower sections and may grip said keyboard therebetween, and said outer surface extends along said upper and lower sections where said outer surface of said lower section may rest on a desk or table and said outer surface of said upper section provides a surface that may be used to support a keyboard operator's wrists;

b) pad means for increasing said keyboard operator's comfort by providing a soft surface upon which the operator's wrists or hands may rest, said pad means being located on the outer surface of said upper section of said member.

11. The apparatus of claim 9, further comprising elastomeric strips extending along said upper and lower sections of said member, where said elastomeric strips provide desktop finish protection and prevent slippage of the apparatus and said keyboard, as well as aid in gripping said keyboard between said upper and lower sections of said member.

12. The apparatus of claim 10, further comprising elastomeric strips extending along said upper and lower sections of said member, where said elastomeric strips provide desktop finish protection and prevent slippage of the apparatus and said keyboard, as well as aid in gripping said keyboard between said upper and lower sections of said member.

13. The apparatus of claim 12, wherein:

a) said pad means comprises a foam rubber pad that is affixed by an adhesive to said outer surface of said upper section;

b) said connecting means is formed by said member folding over on itself so that a rounded end is created, where said rounded end is integrally connected with said upper and lower sections.

14. A device for use by a keyboard operator, comprising:

a) a generally U-shaped wall having first and second portions and a rounded end portion, said first portion having a flat first surface that is adapted to support said operator's wrists or hands when using a keyboard;

b) said end portion connecting said first and second portions together and comprising clamp means for clamping said first and second portions to said keyboard such that said first portion surface is at an elevation that will support said operator's wrists or hands during keyboard operations.

15. A device for use by a keyboard operator, comprising:

a) a first wall having a surface that is adapted to support said operator's wrists or hands when using a keyboard;

b) a second wall separated from said first wall by a gap, said gap having first and second ends, said gap first end being adapted to receive said keyboard with said gap first end being sized smaller than a thickness of said keyboard;

c) resilient spring means for maintaining the distance of said first wall from said second wall, said spring means being coupled to said first wall and to said second wall, said spring means for resisting any enlargement of said gap first end such that said first and second walls at said gap first end are clamped to said keyboard when said keyboard is inserted into said first end.

16. A method of provided a support for a keyboard operator's wrists or hands while using a keyboard, comprising the steps of:

a) providing a generally U-shaped member having a surface that is adapted to support said operator's wrists or hands, said member having an open end and a closed end, with said open end having a gap that is sized smaller than a thickness of said keyboard, said closed end comprising resilient spring means that resists a change in the size of said gap;

b) overcoming said spring means and spreading said gap apart;

c) inserting said keyboard into said spread apart gap;

d) allowing said spring means to shrink said gap such that the open end closes on the keyboard.

17. The method of claim 16 further comprising the step of adjusting the position of said surface relative to said keyboard to adjust for said operator by sliding said surface relative to said keyboard.

18. The apparatus of claim 1 wherein said upper section is inclined relative to said lower section so that said gap is smaller between said respective second ends than between said respective first ends.

19. The device of claim 14 wherein said first portion is inclined towards said second portion as said first portion extends away from said rounded end portion.

* * * * *